United States Patent [19]

Gagnon

[11] 4,158,925

[45] Jun. 26, 1979

[54] AUTO AID

[76] Inventor: Sylvester P. Gagnon, 3919-3rd Ave., Sioux City, Iowa 51106

[21] Appl. No.: 859,311

[22] Filed: Jan. 23, 1978

[51] Int. Cl.[2] ..... G09F 7/18

[52] U.S. Cl. ..... 40/591; 116/28 R

[58] Field of Search ..... 116/42, 174, 132 R, 116/132 A, 28 R, 130; 40/591, 592, 593; 283/23, 18, 21

[56] References Cited

U.S. PATENT DOCUMENTS

| | | | |
|---|---|---|---|
| 1,267,407 | 5/1918 | Harrison | 116/130 |
| 2,534,117 | 12/1950 | Flick | 40/591 |
| 3,060,605 | 10/1962 | Flack | 116/132 R |
| 3,286,386 | 11/1966 | Glantz | 40/592 |
| 3,497,980 | 3/1970 | Brown | 116/132 R |
| 3,623,254 | 11/1971 | Parish | 40/591 |
| 3,738,039 | 6/1973 | De Furia | 40/591 |
| 4,091,553 | 5/1978 | Glennie | 40/591 |

*Primary Examiner*—S. Clement Swisher
*Assistant Examiner*—Denis E. Corr

[57] ABSTRACT

A device used in aiding stranded and disabled automobiles. In being able to communicate with passing motorists while disabled along the highway. The kit will consist of a rod holder, which mounts on the window rod, and a series of numbers visible to passing motorists which will represent the type of automobile problem you have. This will enable a passing motorist if you are disabled, the nature of the problem and also if he can be of assistance. The kit will also be of assistance to Police Departments and Highway Officials in disposing of your automobile while abandoned along the highway.

1 Claim, 17 Drawing Figures

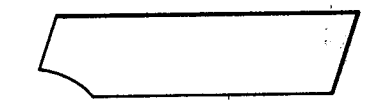
FIG. 5
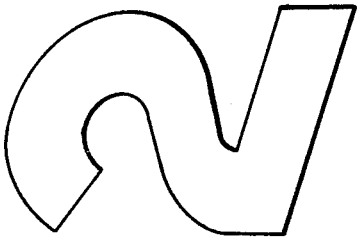
FIG. 6
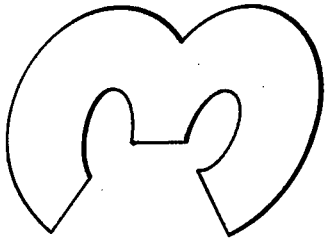
FIG. 7
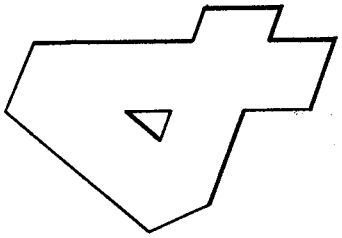
FIG. 8
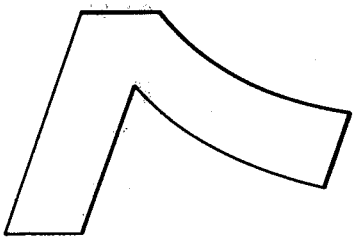
FIG. 9
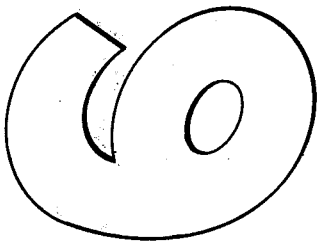
FIG. 10
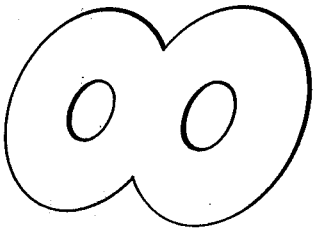
FIG. 11
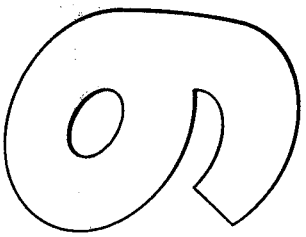
FIG. 12
FIG. 13

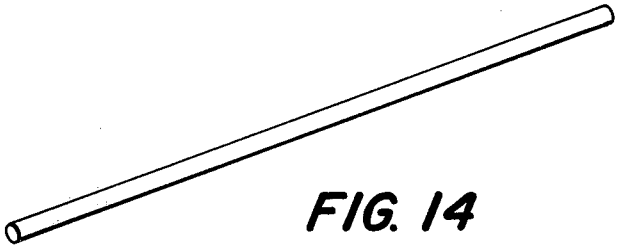
FIG. 14
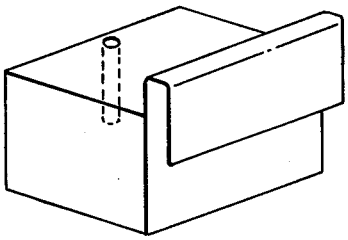
FIG. 15
| AUTO AIDE |
|---|
| 1 FLAT TIRE |
| 2 NEED WATER |
| 3 NEED GASOLINE |
| 4 NEED A RIDE |
| 5 POLICE |
| 6 TOW TRUCK |
| 7 PHONE CALL |
| 8 HELP ON THE WAY |
| 9 DEAD BATTERY |
FIG. 16

AUTO AID

BRIEF DESCRIPTION OF DRAWINGS

The advantages, usefullness, and simplicity of the auto aid are shown thru the following figures.

FIGS. 5 Thru 13 shows the numbers to be used that represent the type of automobile problem.

FIG. 14 shows the rod to be used to connect numbers to the rod holder,

FIG. 15 is the rod holder showing the hole for the rod and the clip that fits over the window which enables the number to be supported.

FIG. 16 is a small sticker to be placed inside the glove compartment door, with the numbers that represent the type of assistance needed.

DETAILED DESCRIPTION

The Auto Aid is a device where a disabled motorist receive aid from passing motorist by a means of communicating, when displaying numbers which represent the need of a disabled motorist.

Figure 1:
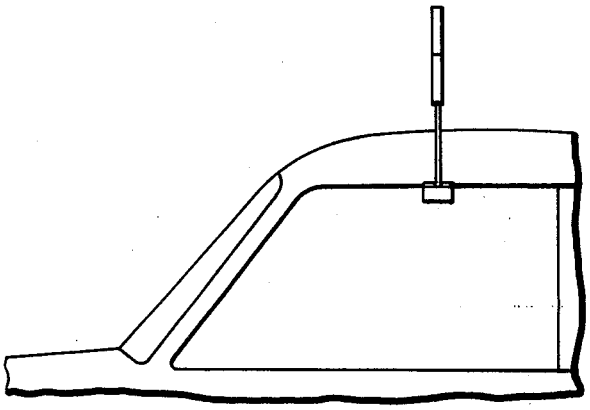
FIG. 1 is a cut away portion of an automobile, side view of the rod holder, rod, and a rigid number in place with the window in a raised position.
Figure 2:
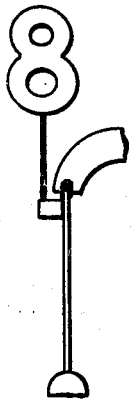
FIG. 2 is a cut away portion of an automobile (rear and front view) as seen to passing motorists with rod, rod holder, and a rigid number in place with the window in a raised position with a face of the number oriented toward on coming traffic.
Figure 3:
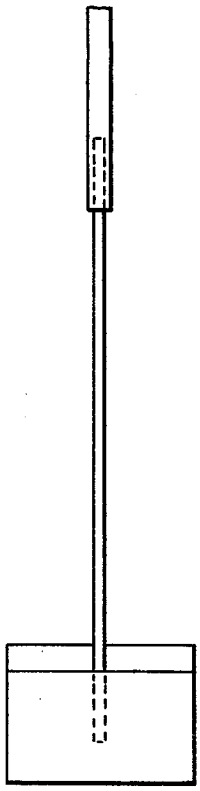
FIG. 3 shows the side view of rod holder cut away portion with the rod in the holder and the rod in the number.
Figure 4:
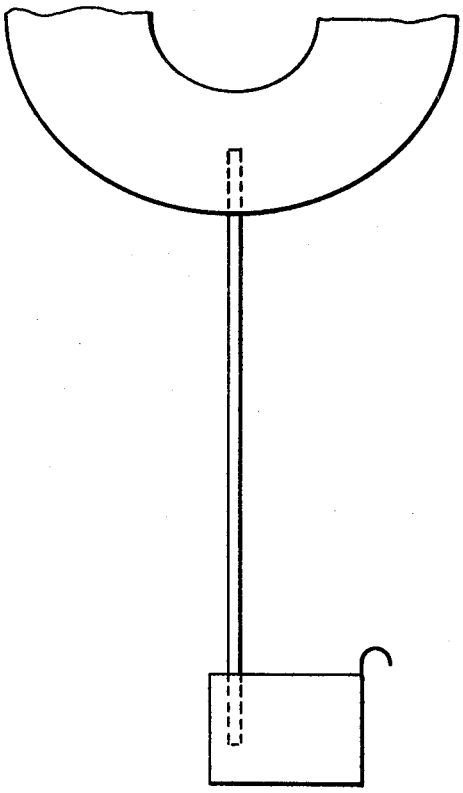
FIG. 4 shows flat side of the rod holder, with rod in the holder and the rod in the number.
Figure 17:
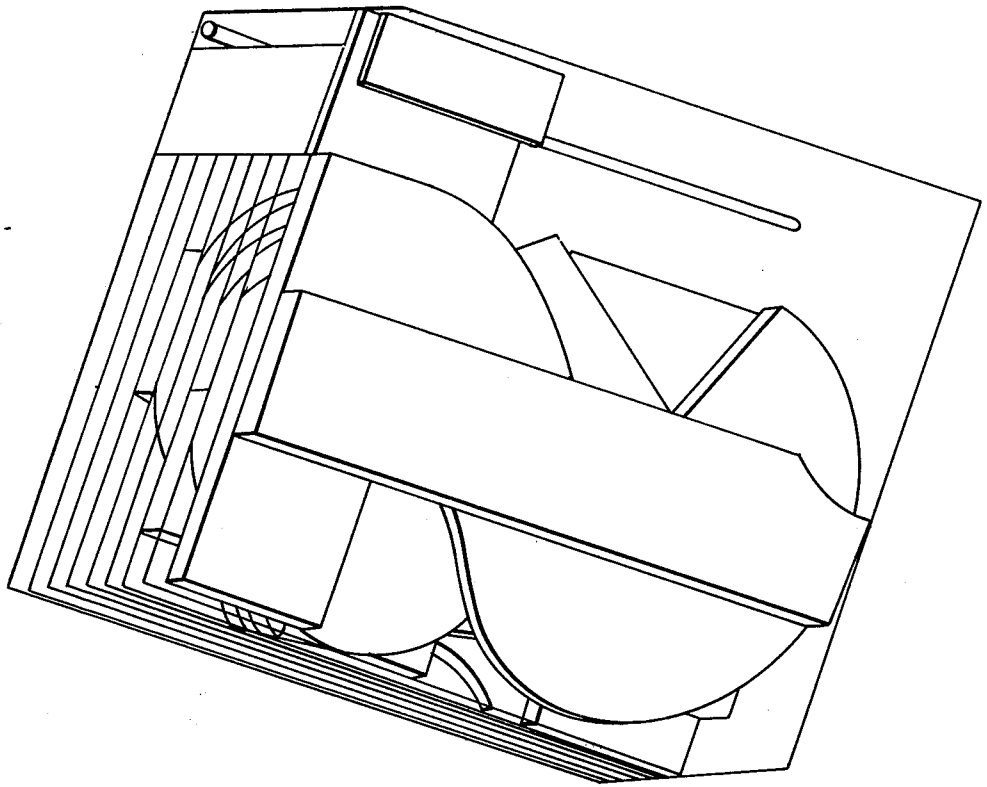
FIG. 17 shows the complete kit in a plastic box with said numbers stacked face to face.

The auto aid kit FIG. 17 contains one rod holder FIG. 15 which has a hole three sixteenths inches in diameter and one and one half deep placed in the center top of the holder. The holder has a clip on one side that fits over the window to support the number FIG. 2. By placing the rod FIG. 14 in the rod holder FIG. 15 you can display a number which will represent the assistance needed.

If the driver of an automobile is forced to abandon his automobile along the highway, such a device would be of great value to Policeman and Highway Officials as to the action to be taken with your automobile. In FIG. 16 a number 6 displayed on the automobile would show to tow it in, or a 8 would show that help is on the way.

The kit is made up of all plastic material which would with stand heat, cold, and rain. The numbers are to be of a bright floresent orange to be seen in the day and night, the overall dimensions of the numbers are four inches in width and eight inches tall and one quarter inches thick. The rod FIG. 14 will be one quarter inch thick and eight inches in length.

The kit (AUTO AID) being made of simple construction would make it useable by anyone and of great usefullness of not only the user but others involved with disabled automobiles.

I claim:

1. A kit to be used with automobiles to obtain aid for a disabled motor vehicle along the road comprising;

a plurality of means, each of said plurality individually having two rigid flat faces forming a number, a rod to support each of said plurality of means, holding means for fastening said rod to said motor vehicle, decal means for placement with said vehicle showing the relationship of each said number to a particular trouble that said disabled motor vehicle may have and, a box to compactly hold at least said plurality of number forming means stacked face to face, said rod, and said holding means.

* * * * *